US010697293B2

(12) United States Patent
Nemoto et al.

(10) Patent No.: US 10,697,293 B2
(45) Date of Patent: Jun. 30, 2020

(54) METHODS OF OPTIMAL SELECTION AND SIZING OF ELECTRIC SUBMERSIBLE PUMPS

(71) Applicant: General Electric Company

(72) Inventors: Rafael Horschutz Nemoto, Rio de Janeiro (BR); Jose Luiz Bittencourt, Rio de Janeiro (BR)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 609 days.

(21) Appl. No.: 15/607,160

(22) Filed: May 26, 2017

(65) Prior Publication Data

US 2018/0340416 A1 Nov. 29, 2018

(51) Int. Cl.
*E21B 49/00* (2006.01)
*F04D 13/10* (2006.01)
(Continued)

(52) U.S. Cl.
CPC ..... *E21B 49/003* (2013.01); *E21B 41/0007* (2013.01); *E21B 43/128* (2013.01);
(Continued)

(58) Field of Classification Search
CPC .. E21B 49/003; E21B 41/0007; E21B 43/128; E21B 49/001; E21B 2041/0028; F04D 13/12; F04D 15/0066; F04D 31/00
(Continued)

(56) References Cited

U.S. PATENT DOCUMENTS

2003/0015320 A1 1/2003 Crossley
2004/0267395 A1* 12/2004 Discenzo ..... G05B 13/024 700/99

(Continued)

FOREIGN PATENT DOCUMENTS

EP 0768237 A1 4/1997
WO 2014/160581 A1 10/2014

OTHER PUBLICATIONS

Helm_2015 (Pumps Efficiency and Adaptability Dec. 2, 2015 SHC Solar Heating & Cooling Programme International Energy Agency) (Year: 2015).*

(Continued)

*Primary Examiner* — Brian S Cook
(74) *Attorney, Agent, or Firm* — Laura L. Pollander

(57) ABSTRACT

The present approach includes implementations for generating thermos-hydraulic data via a simulation and evaluating the thermo-hydraulic data pertaining to one or more parameters of a production system. The approach includes receiving operating parameters and receiving coefficients of polynomials for constructing a plurality of pump performance curves. The approach includes performing a selection step. The selection step includes selecting a pump from a plurality of pump types, and sizing the pump based in part on the thermo-hydraulic data, the operating parameters, and the coefficients of polynomials. The approach includes repeating the selection step until each pump of the plurality of pump types has been considered to generate a subset of pumps from the plurality of pump types. The approach includes performing an optimization step on the subset of pumps. The approach includes generating a visual display to identify the set of preferred pumps.

20 Claims, 6 Drawing Sheets

(51) Int. Cl.

| | |
|---|---|
| ***E21B 41/00*** | (2006.01) |
| ***E21B 43/12*** | (2006.01) |
| *F04D 15/00* | (2006.01) |
| *F04D 31/00* | (2006.01) |

(52) U.S. Cl.
CPC ..... *F04D 13/10* (2013.01); *E21B 43/12* (2013.01); *E21B 49/001* (2013.01); *E21B 2041/0028* (2013.01); *F04D 15/0066* (2013.01); *F04D 31/00* (2013.01)

(58) Field of Classification Search
USPC ..... 703/10
See application file for complete search history.

(56) References Cited

U.S. PATENT DOCUMENTS

| | | | | |
|---|---|---|---|---|
| 2006/0175064 | A1 | 8/2006 | Yuratich | |
| 2008/0262736 | A1 | 10/2008 | Thigpen et al. | |
| 2013/0151216 | A1 | 6/2013 | Palka et al. | |
| 2013/0175030 | A1* | 7/2013 | Ige ..... | E21B 43/128 166/250.15 |
| 2014/0039836 | A1 | 2/2014 | Moricca et al. | |
| 2015/0241881 | A1 | 8/2015 | Ige et al. | |
| 2015/0316072 | A1 | 11/2015 | Cunningham et al. | |
| 2016/0265323 | A1 | 9/2016 | Rendusara et al. | |
| 2016/0312552 | A1 | 10/2016 | Early et al. | |
| 2016/0356125 | A1 | 12/2016 | Bello et al. | |
| 2017/0045055 | A1 | 2/2017 | Hoefel et al. | |

OTHER PUBLICATIONS

Cunkas, Mehmet, et al.; "Cost Optimization of Submersible Motors Using a Genetic Algorithm and a Finite Element Method", The International Journal of Advanced Manufacturing Technology, vol. 33, Issue 3, pp. 223-232, Jun. 2007.

Chikwere, Ezekiel, et al.; "Economic Evaluation of Electrical Submersible Pump (ESP) and Gas Lift Well for Production Optimization in a Niger Delta Field", International Journal of Engineering and Technology, vol. 5, No. 1, Jan. 2015.

International Search Report and Written Opinion issued in connection with corresponding PCT Application No. PCT/US2018/031930 dated Nov. 8, 2018.

U.S. Appl. No. 15/421,843, filed Feb. 1, 2017, JosëBittencourt

* cited by examiner

METHODS OF OPTIMAL SELECTION AND SIZING OF ELECTRIC SUBMERSIBLE PUMPS

BACKGROUND

Embodiments of the present invention relate generally to electric submersible pumps (ESPs), and more particularly to methods of selecting and sizing an electric submersible pump.

Subterranean areas of interest are typically accessed through a borehole. The borehole is surrounded by subterranean material such as sand that may migrate out of the borehole along with oil, gas, water, and/or other fluid generated from a well. An outermost casing is inserted in the borehole and held in place using cement in the space between an outer surface of the casing and surrounding earth. The fluid produced from the well flows to the surface through a production tubing. A variety of fluid lifting systems are in use to pump the fluid from the wellbore to earth's surface. For example, an electric submersible pump (ESP) can be disposed in the wellbore for extracting the fluid to boost subsea production.

Conventionally, a pump used in ESP applications is selected and sized manually as a user goes through several attempts to find a suitable pump for an application via a trial-and-error method. Moreover, the user has to account for many factors, including process limitations and equipment operating limitations (e.g., working inside the recommended flow rate operation range, brake horse power (BHP) limits, etc.). The user also has to account for a final objective or goal, such as maximizing oil production. Unfortunately, selecting and sizing the pump via trial-and-error can be time consuming, and the success of the trial-and-error method depends in part on the experience of the user.

BRIEF DESCRIPTION

In one embodiment, a method includes generating thermo-hydraulic data, via a simulation, pertaining to one or more parameters of a production system. The method includes evaluating, via a processor-based controller, the thermo-hydraulic data. The method includes accessing operating parameters based in part on the production scenario. The method includes accessing coefficients of polynomials for constructing a plurality of pump performance curves. The method includes performing a selection step via the processor-based controller. The selection step includes selecting a pump from a plurality of pump types, and sizing the pump based in part on the thermo-hydraulic data, the operating parameters, and the coefficients of polynomials. The method includes repeating the selection step until each pump of the plurality of pump types has been considered to generate a subset of pumps from the plurality of pump types. The method includes performing an optimization step, via the processor-based controller, on the subset of pumps. The optimization step includes calculating one or more pump indices for each pump of the subset of pumps, and comparing the one or more pump indices for each pump of the subset of pumps to an optimization parameter to identify a set of preferred pumps. The method includes generating a visual display, via the processor-based controller, to identify the set of preferred pumps.

In another embodiment, a method for deploying a pump in an electric submersible pump application (ESP) includes identifying a plurality of pumps that may be suitable for the ESP application. The method includes performing, via a processor-based controller, a selection step. The selection step includes selecting a first pump from a plurality of pump types and sizing the first pump based in part on the thermo-hydraulic data, operating parameters, and one or more coefficients of polynomials. The method includes repeating the selection step until each pump of the plurality of pump types has been considered to generate a subset of pumps from the plurality of pump types. The method includes performing, via the processor-based controller, an optimization step on the subset of pumps. The optimization step includes calculating one or more pump indices for each pump of the subset of pumps and comparing the one or more pump indices for each pump of the subset of pumps to an optimization parameter to identify a set of preferred pumps. The method includes generating, via the processor-based controller, a visual display to identify the set of preferred pumps. The method includes deploying a suitable pump from the set of preferred pumps for use in the ESP application.

In another embodiment, a tangible, non-transitory computer-readable media storing computer instructions thereon, the computer instructions, when executed by a processor, are configured to generate thermo-hydraulic data, via a simulation, pertaining to parameters of a production system. The computer instructions evaluate the simulated thermo-hydraulic data and access operating parameters based in part on a production scenario. The computer instructions access coefficients of polynomials for constructing a plurality of pump performance curves. The computer instructions perform a selection step. The selection step includes selecting a pump from a plurality of pump types and sizing the pump based in part on the thermo-hydraulic data, the operating parameters, and the coefficients of polynomials. The computer instructions repeat the selection step until each pump of the plurality of pump types has been considered to generate a subset of pumps from the plurality of pump types. The computer instructions perform an optimization step on the subset of pumps. The optimization step includes calculating one or more pump indices for each pump of the subset of pumps and comparing the one or more pump indices for each pump of the subset of pumps to an optimization parameter to identify a set of preferred pumps. The computer instructions generate a visual display to identify the set of preferred pumps.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
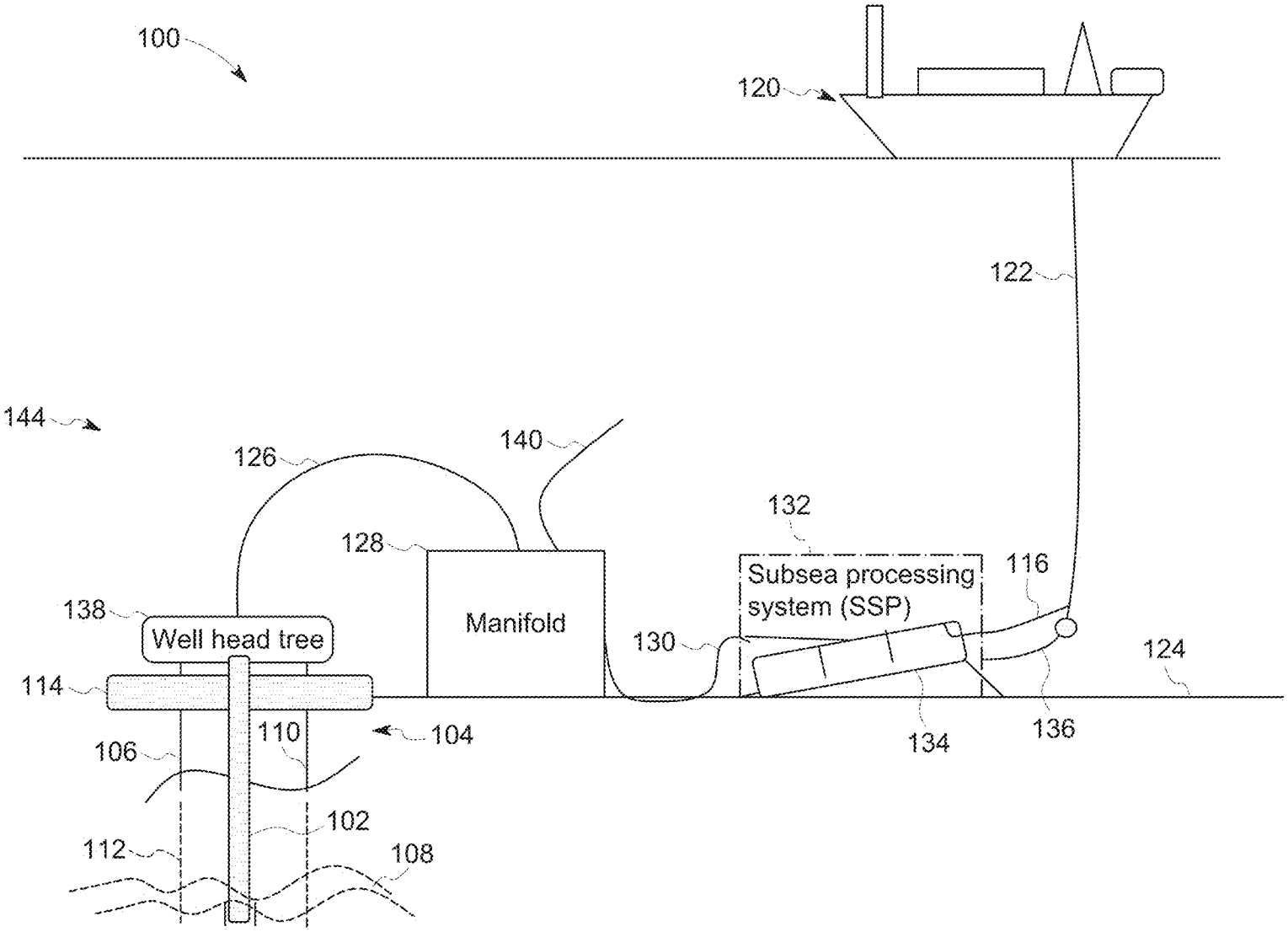
FIG. 1 is a schematic illustration of a subsea production system having an electric submersible pump (ESP) for extraction of a first fluid, for example, a production fluid in accordance with an exemplary embodiment.

As will be described in detail hereinafter, embodiments of a system and method for improved selection and sizing a pump for electric submersible pump (ESP) applications are disclosed. Though the following description generally pertains to ESPs, it may be appreciated that the disclosed embodiments for selecting and sizing pumps may be used for other rotodynamic pumps, such as radial-flow pumps, axial-flow pumps and mixed-flow pumps. The embodiments disclosed herein include receiving input data, performing a pump selection step, performing a pump optimization step, and displaying a visual output to alert a user of the suitable pump(s) for a given production scenario. The given production scenario may be defined in part by fluid properties data, reservior data, well completion data, subsea jumper, flowline, and riser data, production requirements, job conditions, environmental considerations, and/or properties of the formation, among other factors.

As described in detail below, the input data may include thermo-hydraulic data associated with the ESP, such as temperature data of a production fluid and/or a component, pressure data of the production fluid and/or a component, vibrational data of a pump and/or a motor along an x-axis and a z-axis, a discharge pressure at an outlet of the pump, a pressure differential across the pump, a current reading associated with the motor, etc. The input data may also include optimizing parameters (e.g., maximization and/or minimization criteria) that is received via a user input. For example, the maximization criteria could include operations requirements to maximize oil production or to maximize a ratio of oil production to a number of stages. The input data may include coefficients of polynomials to reproduce standard curves of head, efficiency and brake horse power (BHP). The input data may also include a boosting configuration based in part on where the ESP is deployed (e.g., along the mudline, disposed in the wellbore, etc.). Still further, the input data may include restriction data, such as a BHP range (e.g., an upper BHP limit), parameters affecting gas-locking, limiting pump operation to a recommended flow rate, or other limits affecting the operation (e.g., reliability) of the ESP.

The pump selection step may include selecting a pump type from the pump portfolio and subsequently analyzing the pump type. The pump type may be sized to define a number of pump stages necessary to achieve a desired condition (e.g., a pump output flow rate). When the pump is sized, various factors may be considered, including the type of pump (e.g., a housing pressure, a torque measurement, materials of construction, etc.), process fluid variables (e.g., a viscosity of the fluid, specific gravity, fluid pressure, solid contents, shear sensitivity, etc.), pump conditions (e.g., a head degradation effect), pump criticality to an operation, pump environment, flow rate and pressure, and so forth. The pump selection step is repeated until each of the pump types from the pump portfolio is considered. Next, the pump optimization step is performed. Optimization of the pump may include calculation of one or more indices related to each pump type. The optimization step may include criteria to reduce consumption of BHP, criteria to adjust the operation of the pump to account for a boosting configuration, or criteria to otherwise adjust the pump operation based on the given production scenario. After the pump optimization step is performed, a visual output may be displayed to identify one or more optimal pumps for the given production scenario.

FIG. 1 is a diagrammatic illustration of a subsea production system 100 used for extraction of a first fluid, for example, a wellbore fluid in accordance with an exemplary embodiment. In the following discussion, the term 'subsea' refers to a region below the sea surface and includes sea-bed and wells drilled downwards from the sea-bed. Apparatus, components, and systems used for extracting wellbore fluids, installed on the seabed and in a wellbore, may be referred to as a 'subsea production system'. The subsea production system 100 includes a production unit 120 disposed on a vessel or a fixed platform or onshore. The production unit 120 may be coupled to a riser system 122 and configured to receive the first fluid from subsea 144 through the riser system 122. The riser system 122 may be coupled to a flow line 136 and configured to receive the first fluid from a flow line 136. Although the riser system 122 shown in the illustrated embodiment is a single riser system, in other embodiments, a plurality of riser systems may be used. The flow line 136 may be coupled to a subsea processing system 132 including an electric submersible pump (ESP) 134 and configured to receive the wellbore fluid (e.g., a production fluid) from the ESP 134. The subsea production system 100 further includes a manifold 128 coupled to a plurality wells through a plurality of respective well jumpers 126, 140. The well jumper 126 is used to transfer the first fluid from the well 104 to the manifold 128. For the ease of illustration, in the illustrated embodiment, only one well 104 is shown. The first fluid from another well is transferred to the manifold 128 through the well jumpers 140. The manifold 128 is configured to control, distribute, and monitor flow of the first fluid. The subsea production system 100 further includes a well head tree 138 used to couple a well head 114 to the well jumper 126. The well head tree 138 is configured to control the flow of the first fluid from the well 104.

The well 104 includes a wellbore 106 drilled into a geological formation 108 having the first fluid, including but not limited to, petroleum and shale gas. The well 104 further includes a casing 110 disposed in the wellbore 106. The casing 110 includes a plurality of perforations 112 to enable flow of the first fluid from the geological formation 108 to the wellbore 106. A production tubing 102 may be provided within the wellbore 106 to transport the first fluid outwards from the wellbore 106. A power cable 116, for example, an umbilical cable, is provided through the riser system 122 to supply electric power to the ESP 134 disposed on a seabed 124. In another embodiment, the power cable 116 may be outside the riser system 122 and insulated from the subsea surroundings. In such an embodiment, the power cable 116 is connected to the production unit 120. The ESP 134 may be used to pump the first fluid from the geological formation 108 via the wellbore 106. In some embodiments, other related equipment such as piping and valves may be coupled to the production unit 120 to distribute and control flow of extracted first fluid from the geological formation 108 of the wellbore 106.

In one embodiment, the ESP 134 is placed horizontally or slightly inclined on the seabed 124. The ESP 134 may be directly in contact with sea water or be installed inside a capsule (which emulates the production casing) being, in this case, in direct contact with the production fluid. In another embodiment, the ESP 134 is deployed downhole in the wellbore 106. The embodiments disclosed herein may be used to select and size one or more pumps for use in the ESP applications when the ESP 134 is deployed downhole or along a mudline 130. Further, it may be appreciated that the embodiments disclosed herein may be used to select and size one or more pumps for use in onshore applications.

Figure 2:
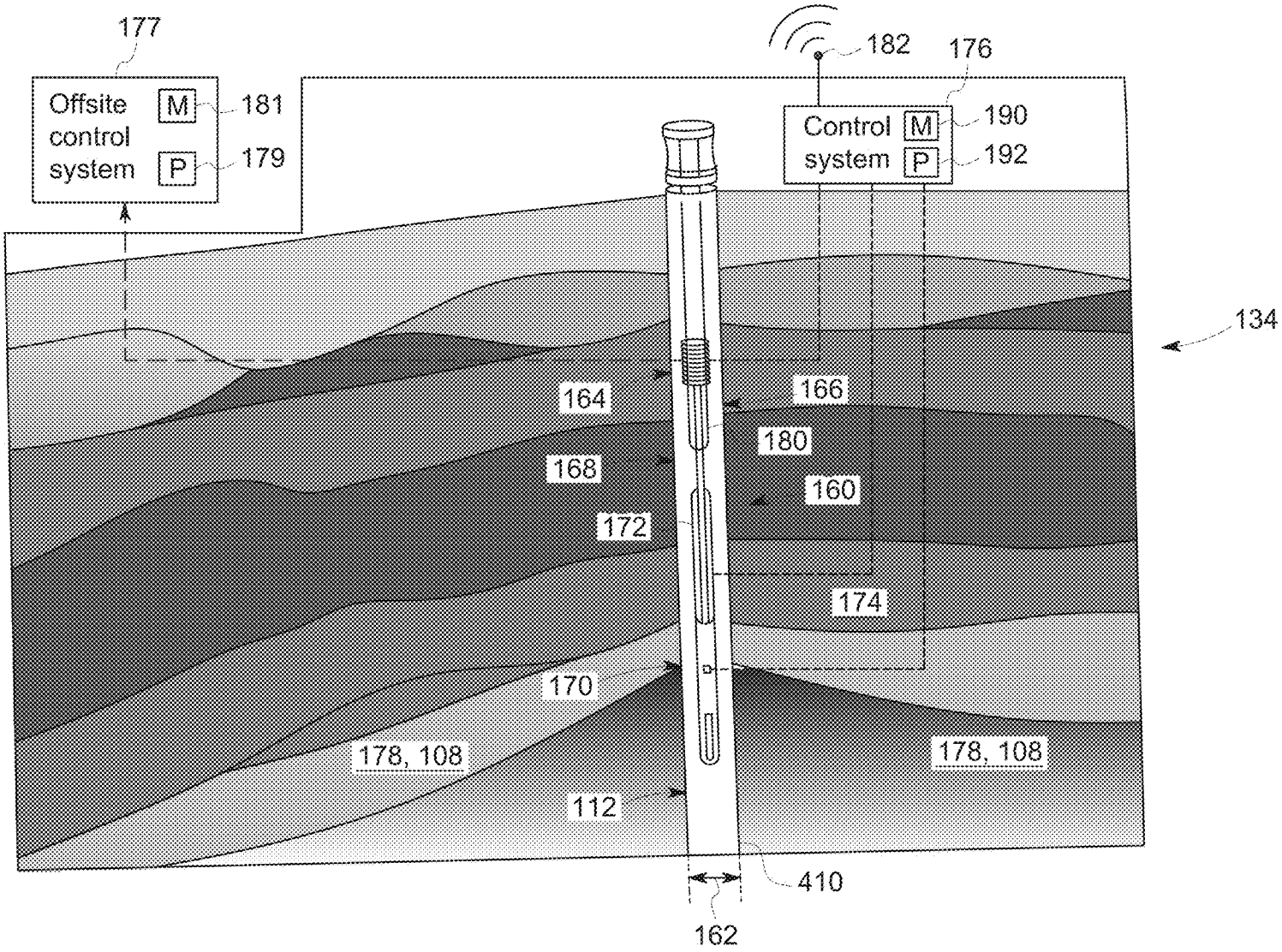
FIG. 2 is a schematic illustration of the ESP depicting various components of the ESP in accordance with an exemplary embodiment.

FIG. 2 is a schematic illustration of the ESP 134 illustrating various components of the ESP in accordance with an exemplary embodiment. The selection and sizing methodologies disclosed herein consider properties of the equipment in some or all of the components 160 of the ESP 134. As may be appreciated by one of skilled in the art, the ESP 134 may be sized or designed based on a diameter 162 of the wellbore 106 and/or the casing 110. The components 160 used within the ESP 134 include at least a pump 164, an intake section 166, a seal 168, a motor 170, one or more sensors 172, one or more cables 174, and a control system 176 communicatively coupled to one or more of the components 160. Each of the components 160 have one or more functions that may have interrelationships and interdependencies with other components 160 that are used to select and size the ESP 134 as described in further detail below.

The intake section 166 is coupled to the pump 164, where the production fluid 178 is drawn into the intake section 166 via a fluid entry point 180. In other words, the intake section 166 may function as a suction manifold feeding the production fluid 178 to the pump 164. In some production scenarios, the intake section 166 may include an adapter with inlet holes to direct the flow to the pump 164. The pump 164 may be used to direct the production fluid 178 from the formation 108 upwards towards a well head. The pump 164 includes a shaft and stages connected to the shaft, the rotation which causes the upward flow and lift of the production fluid 178. The pump 164 is driven by the motor 170, which converts electricity into mechanical power to rotate the shaft of the pump 164. The motor 170 is protected by the seal 168, which bears an axial load from the pump 164. The seal 168 also reduces the chance of a well fluid and/or the production fluid 178 from contaminating the motor dielectric oil. The one or more cables 174 transfer electricity from an electricity source (e.g., a downhole electric power generator, an oilfield battery, etc.) to the motor 170. As may be appreciated, the one or more sensors 172 may be coupled to any one of the components 160 described above. The sensors 172 output signals that are received by the control system 176. The sensors 172 may include pressure sensors, temperature sensors, vibration sensors, seismic sensors, proximity sensors, or any other suitable type of sensor, including General Electric's Osiris downhole sensors. The sensors 172 measure in real-time well and equipment operating parameters and provides measurements of various conditions to optimize the efficiency and reliability of the ESP 134.

Figure 3:
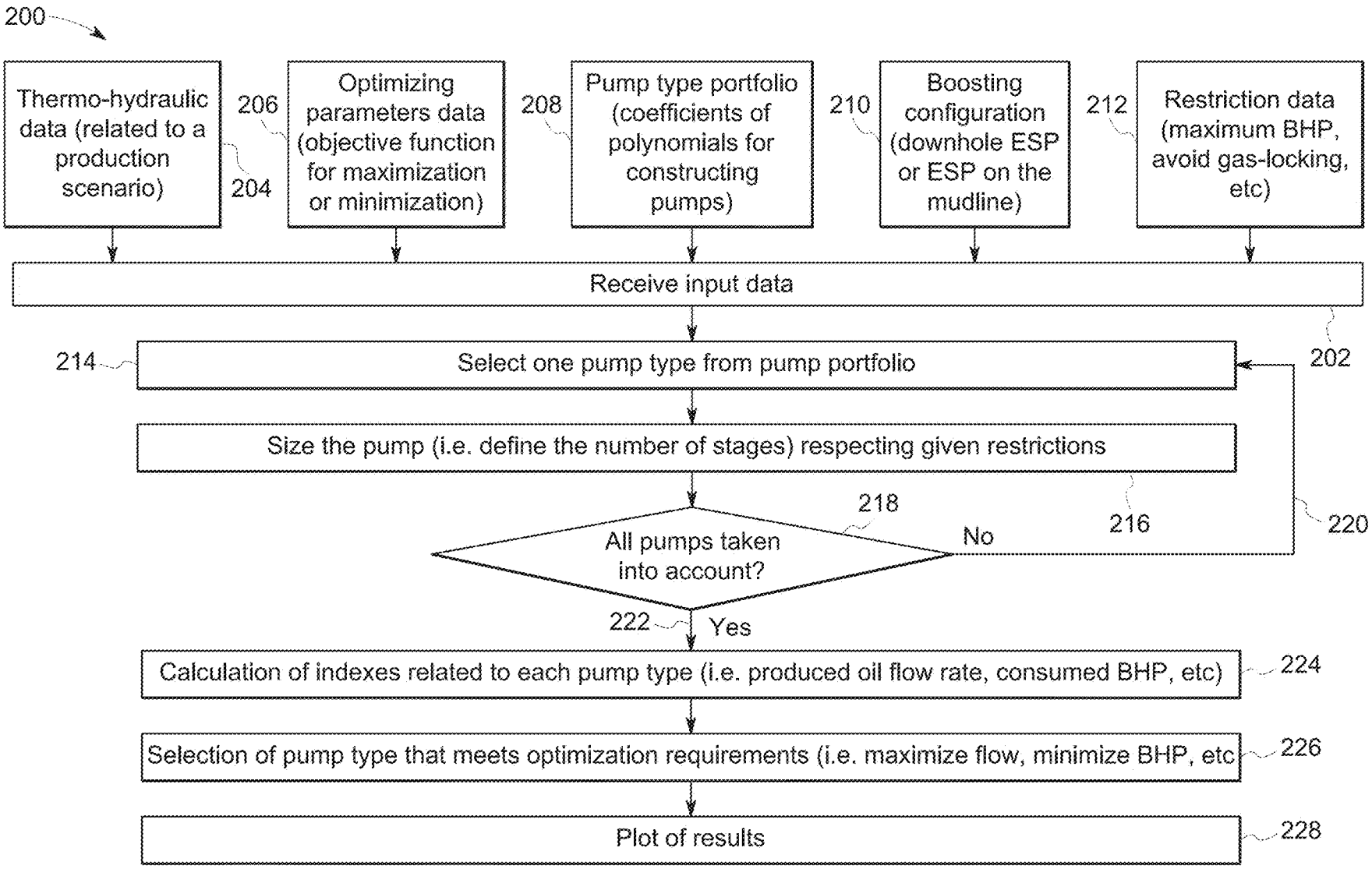
FIG. 3 is a flow chart of a method for selecting and sizing a pump suitable for an electric submersible pump application in accordance with an exemplary embodiment.

Thermo-hydraulic data 204 may be used to select and size the pump 164, as described further with reference to FIG. 3. The thermo-hydraulic data 204 may be obtained via a simulation software (e.g., Aspen HYSYS® (available from Aspen Technology, Burlington, Mass.), PIPESIM® (a registered trademark of Schlumberger Technology Corporation, Houston, Tex.), or other suitable simulation software.). For example, the simulation software may be run to simulate steady-state conditions to obtain the thermo-hydraulic data along the subsea production system 100 (e.g., the riser system 122, the production tubing 102, other components 160, etc.). The thermo-hydraulic data 204 may include temperature data of the production fluid 178 and/or one or more of the components 160, pressure data of the production fluid 178 and/or one or more of the components 160, vibrational data of the pump 164 and/or the motor 170 along an x-axis and a z-axis, a discharge pressure at an outlet of the pump 164, a pressure differential across the pump 164, a current reading associated with the motor, etc.

The control system 176 includes a processor 190 and a memory 192 (e.g., machine-readable medium). In some embodiments, the processor 190 may include one or more processors disposed within the ESP 134. In other embodiments, the processor 190 may include one or more processors 178 disposed within the ESP 134 communicatively coupled with one or more processors 178 in surface equipment (e.g., the control system 176). Thus, any desirable combination of the processors 178 may be considered part of the processor 190 in the following discussion. The processor 190 may include multiple microprocessors, one or more "general-purpose" microprocessors, one or more special-purpose microprocessors, and/or one or more application specific integrated circuits (ASICS), system-on-chip (SoC) device, or some other processor configuration. For example, the processor 190 may include one or more reduced instruction set (RISC) processors or complex instruction set (CISC) processors. The processor 190 may execute instructions or non-transitory code. These instructions may be encoded in programs or code stored in a tangible non-transitory computer-readable medium, such as the memory 192 and/or other storage.

The memory 192, in the embodiment, includes a computer readable medium, such as, without limitation, a hard disk drive, a solid state drive, diskette, flash drive, a compact disc, a digital video disc, random access memory (RAM and/or flash RAM), and/or any suitable storage device that enables the processor 190 to store, retrieve, and/or execute instructions (e.g., software or firmware) and/or data (e.g., thresholds, ranges, etc.). The memory 192 may include one or more local and/or remote storage devices. As described above, the ESP 134 may be communicatively coupled to the control system 176 or other similar surface equipment. More specifically, the ESP 134 may transmit measurements taken or characteristics determined to the control system 176 for further processing. Additionally, in some embodiments, this may include wireless communication between the ESP 134 and the control system 176. Accordingly, the control system 176 may include a wireless unit 182. It may be appreciated that the sizing and selection methods disclosed herein may be executed via an offsite control system 177 separate from the control system 176 coupled to the ESP 134. The control system 177 may use a processor 179 to execute programs and access data stored on a memory 181, as explained further with reference to FIG. 3.

FIG. 3 is a flow diagram illustrating details of an example method 200 for selecting and sizing the pump 164 for use in an electric submersible pump application in accordance with an exemplary embodiment. As described above, the method 200 enables many pumps to be analyzed more efficiently to improve selection and sizing of pumps. 200. The steps of the method 200 may be executed by another control system 177 separate from the control system 176 that is coupled to the ESP 134. The method 200 is initialized by receiving (block 202), via the control system 177, various types of input data to use in selection and sizing methodology described herein. The method 200 includes receiving, via the control system 177, the thermo-hydraulic data (block 204) obtained via the simulation software. The simulation software may be run to simulate steady-state conditions to obtain the thermo-hydraulic data along the subsea production system 100 (e.g., the riser system 122, the production tubing 102, other components 160, etc.).

The method 200 includes receiving or accessing (block 206) optimizing parameters data (e.g., via a database, via a user input). The optimizing parameters may be based on maximization and/or minimization criteria. For example, the maximization criteria could include operational requirements to maximize oil production or to maximize a ratio of oil production to a number of stages. The method 200 includes receiving or accessing (block 208) input data, such as pump performance curves, from General Electric's pump system portfolios. As explained in further detail below, certain coefficients of polynomials may be used to reproduce standard pump curves of head, efficiency and brake horse power (BHP). The curves may then be corrected to account for a given production scenario. The method 200 includes accessing or receiving (block 210) input data to account for a boosting configuration. The boosting configuration may be based in part on where the ESP 134 is deployed (e.g., along the mudline 130, disposed in the wellbore 106, etc.). The method 200 includes receiving or accessing (block 212) restriction data. The restriction data may include a BHP range (e.g., an upper BHP limit), limiting pump operation to a recommended flow rate or other limits affecting the reliability of the ESP 134, or other criteria set by the production scenario. For example, the restriction data may include a calculation of Dunbar' s criterion to avoid or reduce occurrence of gas-locking or considering impact on equipment communicatively coupled to the ESP 134 via the flowline 130 (e.g., a choke valve opening).

Pump Selection and Sizing

The method 200 includes selecting (block 214), via the control system 176, one pump type from the pump portfolio. The method 200 includes sizing (block 216), via the control system 177, the pump 164. The pump 164 is sized by taking into account the production scenario, pump constraints, etc. For example, different shaft rotations (e.g., 3,500 to 7,500 RPM, 4,000 to 6,000 RPM, 4,500 to 5,500 RPM, and all ranges there between) may be considered to determine a number of pump stages. As may be appreciated, the pump type may affect various other sizing-related factors associated with the pump 164. By way of non-limiting example, some of the other sizing-related factors that may be considered include the type of pump (e.g., a housing pressure, a torque measurement, materials of construction, etc.), process fluid variables (e.g., a viscosity of the fluid, specific gravity, fluid pressure, solid contents, shear sensitivity, etc.), pump conditions (e.g., a head degradation effect), pump criticality to an operation, pump environment, flow rate and pressure, and so forth.

The housing pressure limit may be affected by an intake pressure of the pump, fluid density at the pump intake, specific gravity of the fluid, head provided by the pump for a given condition, and so forth. In one embodiment, sizing the pump to account for the thrust loading limit may include evaluating different water cut values (i.e., a water content of the well fluid). For example, the water cut values may be modified from 0% (e.g., a lighter fluid) to 100% (e.g., a heavier fluid) and any percentage there between. The different pump types and different number of stages for each pump sizing may result in different values for a maximum down thrust loading limit. The effects of head degradation, and the viscosity effects set forth by the production fluid 178 as these effects impact the sizing of the pump 164 may be further understood with reference to the pump curves in FIGS. 4-5 below.

The method 200 further includes determining (process block 218), via the control system 177, whether or not all of the pumps have been considered. If the control system 177 determines that there are other pumps in the pump portfolio to analyze (e.g., size), the control system 177 continues (line 220) to analyze the remaining pumps.

Pump Optimization

When the control system 177 determines (line 222) that all of the pumps in the pump portfolio have been analyzed (e.g., sized), the method 200 includes calculating (block 224), via the control system 177, one or more indices of each pump type. The pump indices may include a produced oil flow rate, a consumption of BHP, a pump efficiency, etc. The method 200 includes selecting (block 226), via the control system 177, the pump type(s) that meets optimization requirements (e.g., criteria to maximize oil production, reduced consumption of BHP, adjustment in the operation of the pump to account for a boosting configuration, or otherwise adjustments to the pump operation based on the given production scenario, etc.). The method 200 includes producing (block 228) a visual output (e.g., a plot, etc.) of the resulting pumps that have been identified as suitable pumps. The suitable pumps may be defined as the pumps which were identified by the method 200 as suitable for use in a given production scenario and which were optimized to meet specific criteria (e.g., the optimizing parameters 206, the boosting configuration 208, the restriction data 212, etc.).

Figure 4:
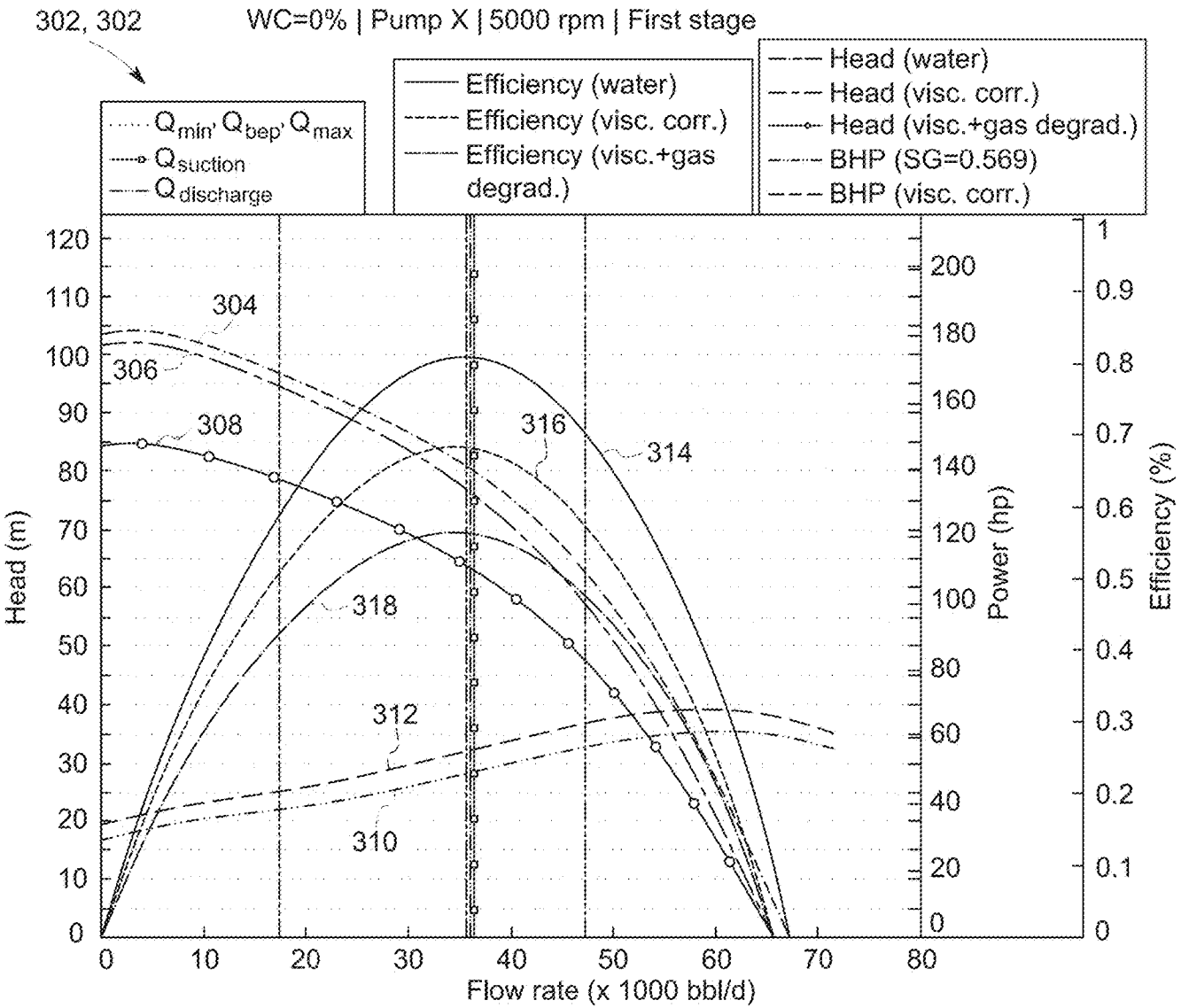
FIG. 4 illustrates a pump curve at a first stage for a first pump of a pump portfolio.
Figure 5:
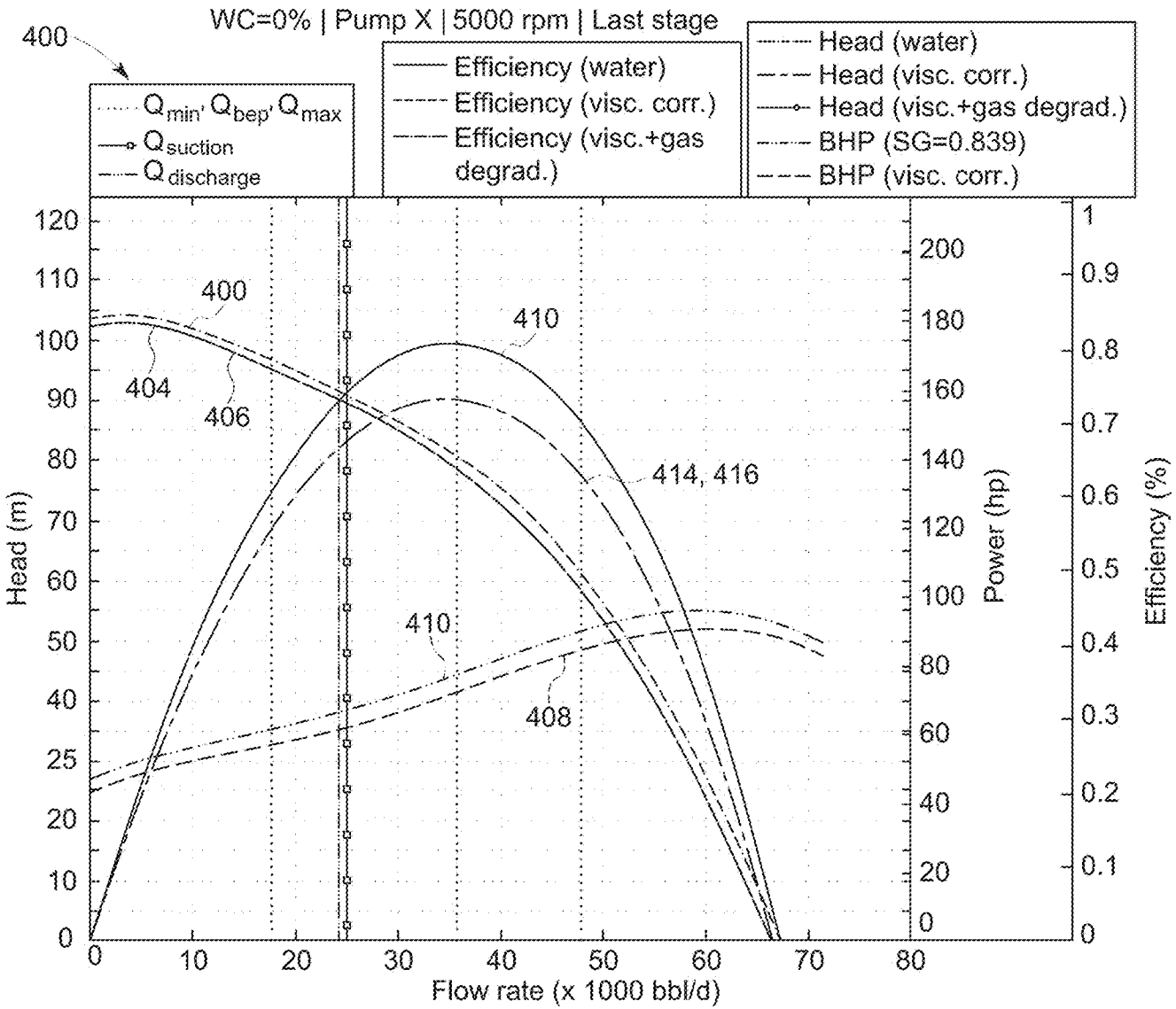
FIG. 5 illustrates a pump curve at a last stage for the first pump of the pump portfolio.
Figure 6:
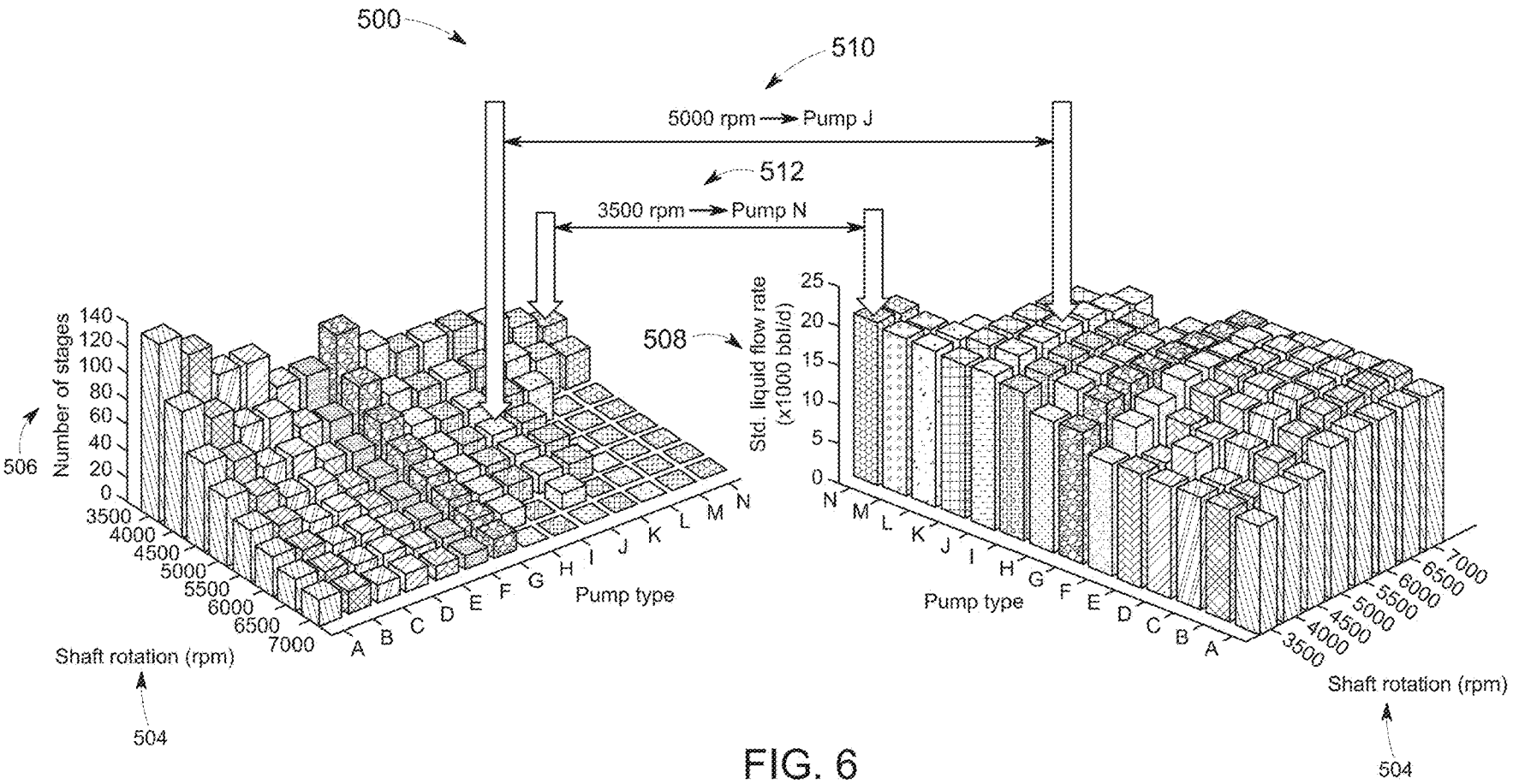
FIG. 6 illustrates a visual display of the pumps identified as suitable pumps for a production scenario.

The method 200 described above may be further understood with reference to the discussion of FIGS. 4-6. FIGS. 4-5 depict the sizing and selection steps described above with reference to FIG. 3 for a given production scenario. FIG. 6 depicts the visual output described above with reference to FIG. 3 to identify the suitable pumps for the given production scenario. In order to size the pumps 164, the standard pump performance curves that include data pertaining to the head, the BHP, and the efficiency for the given pump 164 are corrected by accounting for several factors. One such factor includes adjusting the expected pump performance by accounting for affinity laws by analyzing performance at different shaft rotations. Another factor includes adjusting the expected pump performance by accounting for specific gravity of the fluids mixture (e.g., specific gravity less than 1.0 due to a mixture of hydrocarbons and water). Another factor includes adjusting the expected pump performance by accounting for a viscosity correction. As may be appreciated, the viscosity correction may account for reduced performance due to the increased viscosity of the production fluid 178. Another factor that may be corrected includes adjusting the expected pump performance by accounting for reduced performance due to the composition of the production fluid 178 (e.g., a presence of gas). As may be appreciated, a head capacity of the pump 164 is reduced as a volume of gas increases. By correcting the pump performance curves to account for these factors based on the given production scenario, the pump 164 may be sized more accurately and chances of underestimating a number of pump stages may be reduced.

FIG. 4 illustrates a pump curve 300 at a first stage for a first pump 164 of the pump portfolio. As described above, the pump curve 300 provides various data 302 pertaining to the pump 164, including pump head, pump efficiency, and brake horse power, and a flow rate. The data may be used to analyze the suitability of the pump 164 for the given production scenario. The embodiments disclosed herein provide for sizing the pump 164 by correcting the pump curve 300 by, among other corrective actions, correcting the pump curve 300 for head degradation, correcting the pump curve 300 for viscosity effects, and accounting for maximum BHP limits. By correcting the pump curve 300 to account for the effects on the pump performance for a given production scenario, the most suitable pumps 164 for the given production scenario may be identified.

By way of example, the head (e.g., measure of pressure or force exerted by water in meters) for the pump 164 without any corrective actions is shown by line 304. Corrective actions may be applied to the head measurements. As may be appreciated, the amount of work done by the pump 164 may be impacted by the effects of handling more viscous fluids. As such, the head measurement may be corrected for viscosity effects (line 306) and/or viscosity effects and gas degradation effects (line 308).

The BHP for the pump 164 without any corrective actions is shown by line 310. As described above with reference to head, the BHP may be adjusted for the handling of more viscous fluids as well. When the corrective action is applied to the BHP for the given production scenario, the power used by the pump 164 may be greater as indicated by line 312. The overall pump efficiency, illustrated by line 314, may be corrected to account for viscosity effects (line 316) and/or viscosity effects and gas degradation effects (line 318). Each of the corrective actions described above may aide in more accurately identifying a number of stages to direct the production fluid 178 towards the wellhead.

As may be appreciated, the correction of the standard pump curves, as described above with reference to FIG. 4, may be repeated for the pump 164 at various stages. That is, as the production fluid 178 enters the pump 164 through the intake section 166 and is directed upwards by the pump 164 in various stages, the standard pump performance curves may be corrected to account for changing operating conditions (e.g., viscosity effects, specific gravity effects, etc.) of the production fluid 178 at various stages. FIG. 5 illustrates a pump curve 400 at a last stage for a first pump 164 of the pump portfolio. As described above, in order to size the pump 164, the standard pump performance curves include data pertaining to the head, the BHP, and the efficiency head are corrected by accounting for several factors.

The head (e.g., measure of pressure or force exerted by water in meters) for the pump 164 without any corrective actions is shown by line 402. Corrective actions may be applied to the head measurements. As may be appreciated, the amount of work done by the pump 164 may be impacted by the effects of handling more viscous fluids. As such, the head measurement may be corrected for viscosity effects (line 404) and/or viscosity effects and gas degradation effects (line 406).

The BHP for the pump 164 without any corrective actions is shown by line 408. As described above with reference to head, the BHP may be adjusted for the handling of more viscous fluids as well. When the corrective action is applied to the BHP for the given production scenario, the power used by the pump 164 may be greater as indicated by line 410. The overall pump efficiency, illustrated by line 412, may be corrected to account for viscosity effects (line 414) and/or viscosity effects and gas degradation effects (line 416). Each of the corrective actions described above may aide in more accurately identifying a number of stages to direct the production fluid 178 towards the wellhead.

After each of the pumps 164 is sized, the pumps 164 that meet the sizing restrictions (e.g., a pressure differential, a pump flow rate, avoiding gas locking occurrence, working inside the recommended flow rate operation range, brake horse power limitations, etc.) are further analyzed against one or more pump indices. In some embodiments, the pump indices may be visually displayed (e.g., plotted) for each of the pumps 164 that meets the sizing restriction. FIG. 6 illustrates a visual display 500 of the suitable pumps 164 (e.g., a subset of pumps that have been sized for the restraints set forth by the production scenario). The visual display 500 may be a plot, chart, graphical representation, list, table, or any other suitable visual display 500. The visual display 500 includes an indication of a type of pump (e.g., Pump A, Pump B, Pump C, . . . , Pump N) along a first axis 502. The visual display 500 includes an indication of a shaft rotation (e.g., 3,500 RPM, 4,000 RPM, 4,500 RPM, . . . , 7,000 RPM) along a second axis 504. The visual display 500 may include a third axis 506 and a fourth axis 508. The third axis 506 and the fourth axis 508 may include an optimization criteria or other criteria to help the user identify which pumps 164 of the suitable pumps may be selected for use in a given production scenario. By further taking into account other specific criteria (e.g., the optimizing parameters 206, the restriction data 212, etc.), the user may select the pump 164 based on a specific criterion. In one embodiment, the third axis 506 identifies a number of pump stages, while the fourth axis 508 identifies an expected liquid flow rate at standard conditions.

For example, the visual display 500 may identify Pump N as an optimized pump 164 when the pump 164 will be operated at 3,500 RPM (indicated by arrow 510) based on the given production scenario and restriction data. In another example, the visual display 500 may identify Pump J as the optimized pump 164 when the pump 164 will be operated at 5,000 RPM (indicated by arrow 512) based on the given production scenario and the restriction data.

Technical effects of the disclosure include an improved selection and sizing technique for the pump(s) in electric submersible pump (ESP) applications. The embodiments disclosed herein include receiving input data, performining a pump selection step, performing a pump optimization step, and displaying a visual output to alert the user of the suitable pump(s) for a given production scenario. As described in detail above, the input data may include thermo-hydraulic data associated with the ESP, optimizing parameters (e.g., maximization and/or minimization criteria), coefficients of polynomials to reproduce standard pump curves of head, efficiency and brake horse power (BHP), a boosting configuration based in part on where the ESP is deployed, and restriction data, such as a BHP range (e.g., an upper BHP limit), parameters affecting gas-locking, limiting pump operation to a recommended flow rate, or other limits affecting the reliability of the ESP. The pump selection step may include selecting a pump type from the pump portfolio and subsequently analyzing the pump type. The pump selection step is repeated until each of the pump types from the pump portfolio is considered. Subsequently, the pump optimization step is performed. Optimization of the pump may include calculation one or more indices related to each pump type. After the pump optimization step is performed, a visual output may be displayed to identify one or more optimal pumps for the given production scenario.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A processor-implemented method comprising:

generating thermo-hydraulic data, via a simulation, pertaining to one or more parameters of a production system;

evaluating, via a processor-based controller, the simulated thermo-hydraulic data;

accessing operating parameters based in part on a production scenario;

accessing coefficients of polynomials for constructing a plurality of pump performance curves;

performing a selection step, via the processor-based controller, comprising:

selecting a pump from a plurality of pump types; and sizing the pump based in part on the thermo-hydraulic data, the operating parameters, and the coefficients of polynomials;

repeating the selection step until each pump of the plurality of pump types has been considered to generate a subset of pumps from the plurality of pump types;

performing an optimization step, via the processor-based controller, on the subset of pumps, comprising:

calculating one or more pump indices for each pump of the subset of pumps;

comparing, via the processor-based controller, the one or more pump indices for each pump of the subset of pumps to an optimization parameter to identify a set of preferred pumps; and generating, via the processor-based controller, a visual display to identify the set of preferred pumps.

2. The method of claim 1, wherein the one or more parameters comprise a density of a production fluid, a temperature of the production fluid, a pressure of the production fluid at an intake, or a composition of the production fluid.

3. The method of claim 1, wherein the one or more parameters comprise a pump vibration along an x-axis or a z-axis, a current leakage, a discharge pressure of the pump output, a motor temperature, or a vibration of the motor along the x-axis or the z-axis.

4. The method of claim 1, wherein the operating parameters comprise an optimizing parameter.

5. The method of claim 4, wherein the optimizing parameter comprises a production flow rate.

6. The method of claim 1, wherein sizing the pump comprises utilizing a sizing restriction to determine a number of pump stages for the production scenario.

7. The method of claim 6, wherein the sizing restriction comprises a pressure differential across the pump, one or more pump effects due to viscosity, one or more pump effects due to head degradation, a brake horse power limit, a suction calculation, operating the pump to reduce an occurrence of gas locking, operating the pump within a recommended range of flow rates, operating the pump within a brake horse power limit.

8. The method of claim 1, wherein the one or more pump indices comprises a production flow rate or a brake horse power consumption.

9. The method of claim 1, wherein the operating parameters comprise a boosting configuration.

10. The method of claim 9, wherein the boosting configuration comprises a first configuration when the pump is deployed in a wellbore or a second configuration when the pump is deployed along a flowline.

11. A method for deploying a pump in an electric submersible pump application comprising:

identifying a plurality of pumps that may be suitable for the electric submersible pump application;

performing, via a processor-based controller, a selection step, comprising:

selecting a first pump from a plurality of pump types;

sizing the first pump based in part on the thermo-hydraulic data, operating parameters, and one or more coefficients of polynomials; and repeating the selection step until each pump of the plurality of pump types has been considered to generate a subset of pumps from the plurality of pump types;

performing, via the processor-based controller, an optimization step on the subset of pumps, comprising:

calculating one or more pump indices for each pump of the subset of pumps;

comparing, via the processor-based controller, the one or more pump indices for each pump of the subset of pumps to an optimization parameter to identify a set of preferred pumps;

generating, via the processor-based controller, a visual display to identify the set of preferred pumps; and deploying a suitable pump from the set of preferred pumps for use in the electric submersible pump application.

12. The method of claim 11, wherein the processor-based controller evaluates thermo-hydraulic data generated via a simulation, wherein the thermo-hydraulic data pertains to one or more parameters of a subsea production system.

13. The method of claim 12, wherein the one or more parameters comprise a density of a production fluid, a temperature of the production fluid, a pressure of the production fluid at an intake, a composition of the production fluid, a pump vibration along an x-axis or an z-axis, a current leakage, a discharge pressure of the pump output, a motor temperature, or a vibration of the motor along the x-axis or the z-axis.

14. The method of claim 11, wherein the processor-based controller receives one or more operating parameters, wherein the operating parameters comprise an optimizing parameter.

15. The method of claim 11, wherein the processor-based controller receives coefficients of polynomials for constructing a plurality of pump performance curves.

16. A tangible, non-transitory computer-readable media storing computer instructions thereon, the computer instructions, when executed by a processor, configured to:

generate thermo-hydraulic data, via a simulation, pertaining to one or more parameters of a production system;

evaluate, via a processor-based controller, the simulated thermo-hydraulic data;

access operating parameters based in part on a production scenario;

access coefficients of polynomials for constructing a plurality of pump performance curves;

perform, via the processor-based controller, a selection step, comprising:

selecting a pump from a plurality of pump types; and sizing the pump based in part on the thermo-hydraulic data, the operating parameters, and the coefficients of polynomials; and repeating the selection step until each pump of the plurality of pump types has been considered to generate a subset of pumps from the plurality of pump types;

perform, via the processor-based controller, an optimization step on the subset of pumps, comprising:

calculating one or more pump indices for each pump of the subset of pumps; and comparing the one or more pump indices for each pump of the subset of pumps to an optimization parameter to identify a set of preferred pumps; and generate, via the processor-based controller, a visual display to identify the set of preferred pumps.

17. The computer-readable media of claim 16, wherein the operating parameters comprise an optimizing parameter, wherein the optimizing parameter comprises a production flow rate or a restriction parameter.

18. The computer-readable media of claim 16, wherein sizing the pump comprises utilizing a sizing restriction to determine a number of pump stages, wherein the sizing restriction comprises a pressure differential across the pump, one or more pump effects due to viscosity, one or more pump effects due to head degradation, a brake horse power limit, a suction calculation, operating the pump to reduce an occurrence of gas locking, operating the pump within a recommended range of flow rates, operating the pump within a brake horse power limit.

19. The computer-readable media of claim 16, wherein the one or more parameters comprises a density of a production fluid, a temperature of the production fluid, a pressure of the production fluid at an intake, or a composition of the production fluid.

20. The computer-readable media of claim 16, wherein the one or more parameters comprises a pump vibration along an x-axis or a z-axis, a current leakage, a discharge pressure of the pump output, a motor temperature, or a vibration of the motor along the x-axis or the z-axis.

* * * * *